United States Patent [19]

Win et al.

[11] Patent Number: 4,833,003

[45] Date of Patent: May 23, 1989

[54] UNIFORMLY MOIST ABRASIVE WIPES

[75] Inventors: Maung H. Win, Neenah, Wis.; Stephen S. Hata, Cedar Rapids, Iowa; William A. Abba, Neenah; James Olszewski, Menasha, both of Wis.

[73] Assignee: Kimberly-Clark Corporation, Neenah, Wis.

[21] Appl. No.: 108,875

[22] Filed: Oct. 15, 1987

Related U.S. Application Data

[63] Continuation-in-part of Ser. No. 896,895, Aug. 15, 1986, Pat. No. 4,775,582.

[51] Int. Cl.[4] ..... B32B 27/14

[52] U.S. Cl. ..... 428/198; 252/91; 428/206; 428/283; 428/286; 428/289; 428/296

[58] Field of Search ..... 428/198, 206, 283, 286, 428/289, 296; 252/91

[56] References Cited

U.S. PATENT DOCUMENTS

| | | | |
|---|---|---|---|
| Re. 31,885 | 5/1985 | Meinter | 252/91 |
| 4,448,704 | 5/1984 | Barby et al. | 252/91 |
| 4,659,609 | 4/1987 | Lamers et al. | 428/194 |
| 4,741,944 | 5/1988 | Jackson et al. | 428/152 |

*Primary Examiner*—Marion C. McCamish
*Attorney, Agent, or Firm*—Gregory E. Croft

[57] ABSTRACT

Layered meltblown abrasive sheets, suitable as wet wipes, exhibit liquid concentration stability over long periods of time. Stacks of these sheets maintain equal liquid concentration from the top to the bottom of the stack notwithstanding evaporation losses through the top of the stack.

9 Claims, 9 Drawing Sheets

Figure 2A Liquid Retention
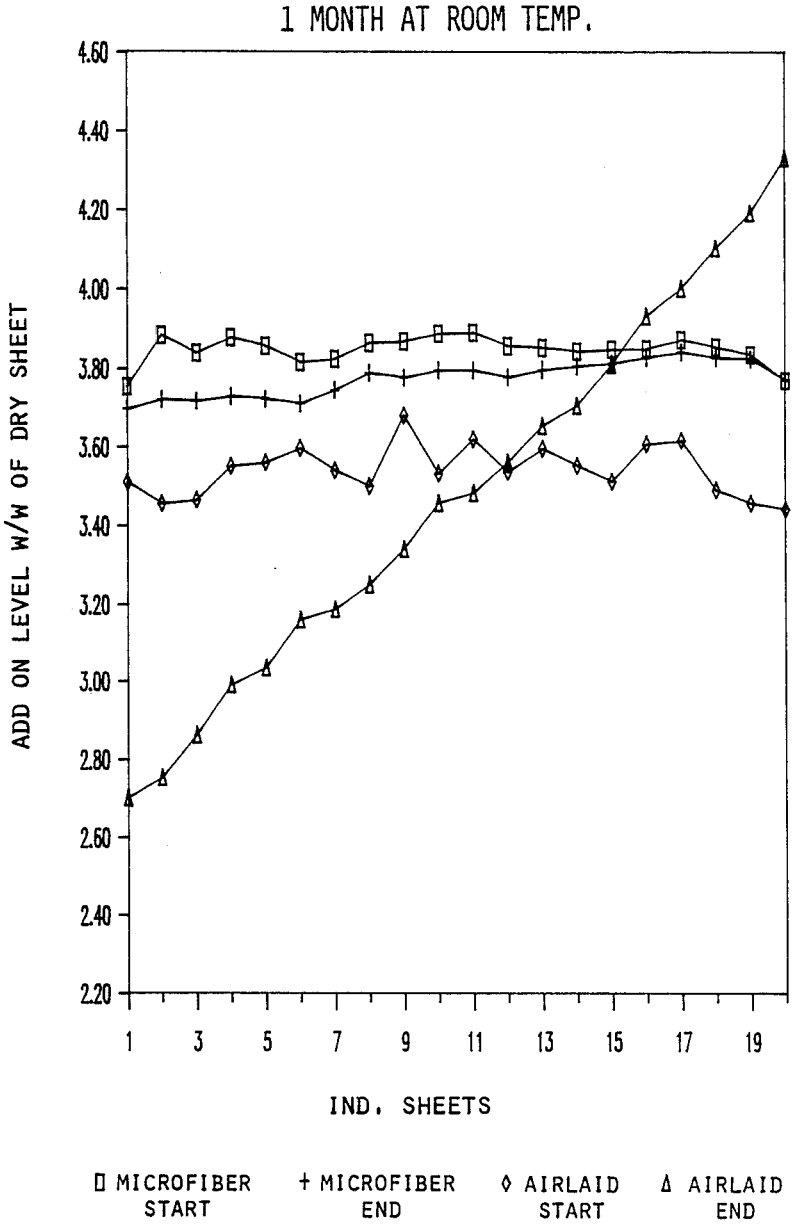

Figure 2B Liquid Retention
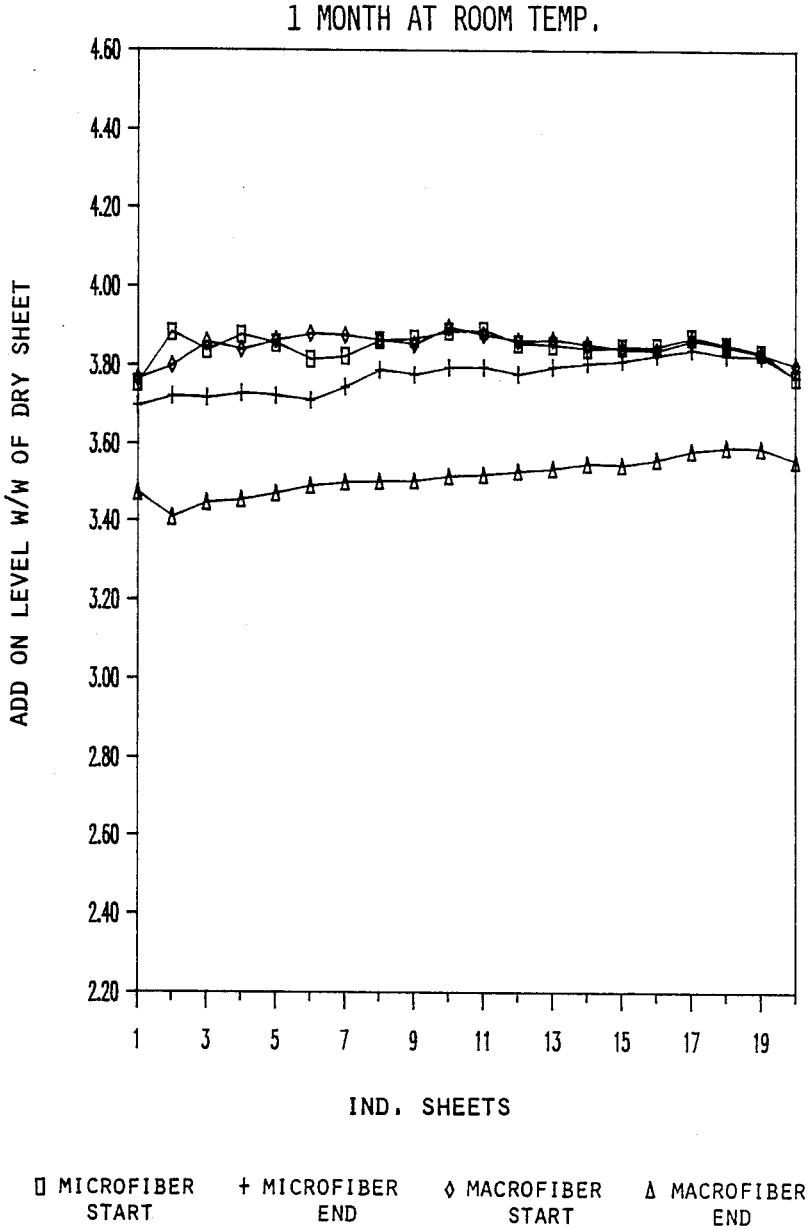

Figure 2C Liquid Retention
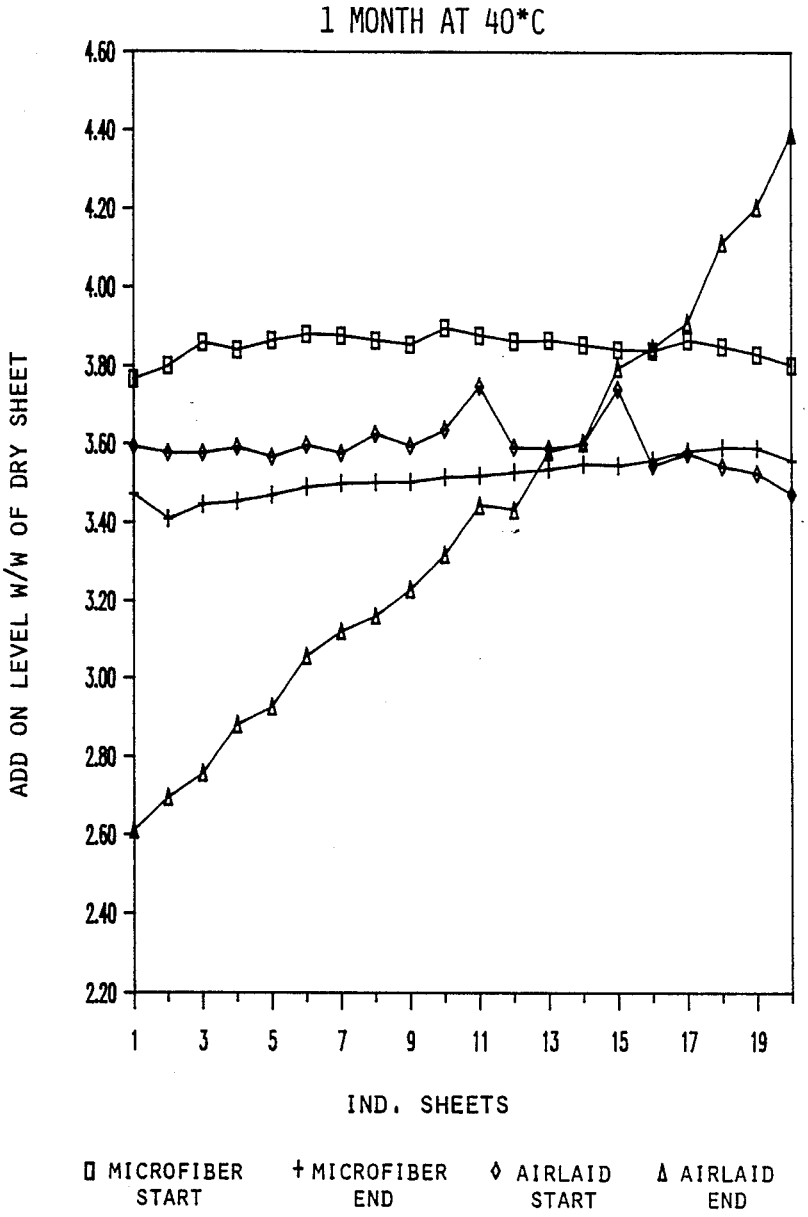

Figure 2D Liquid Retention
1 MONTH AT 40*C
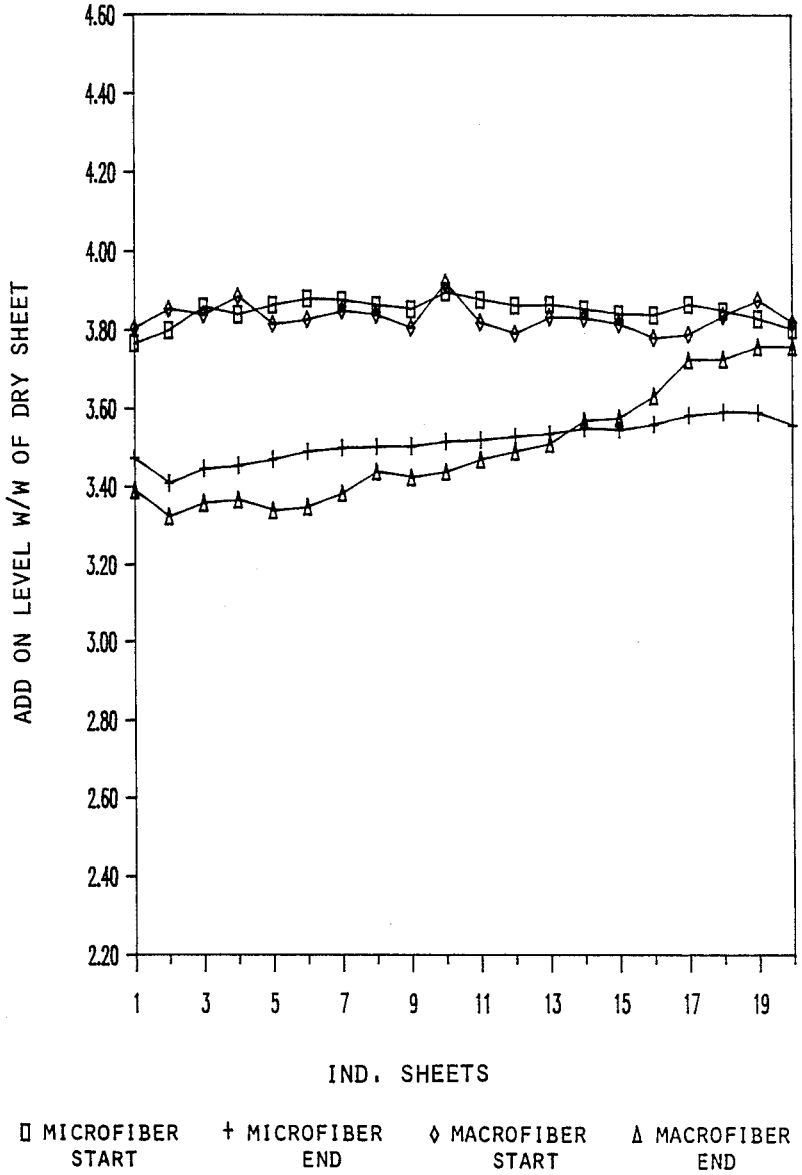

Figure 2E Liquid Retention
1 MONTH AT 50*C
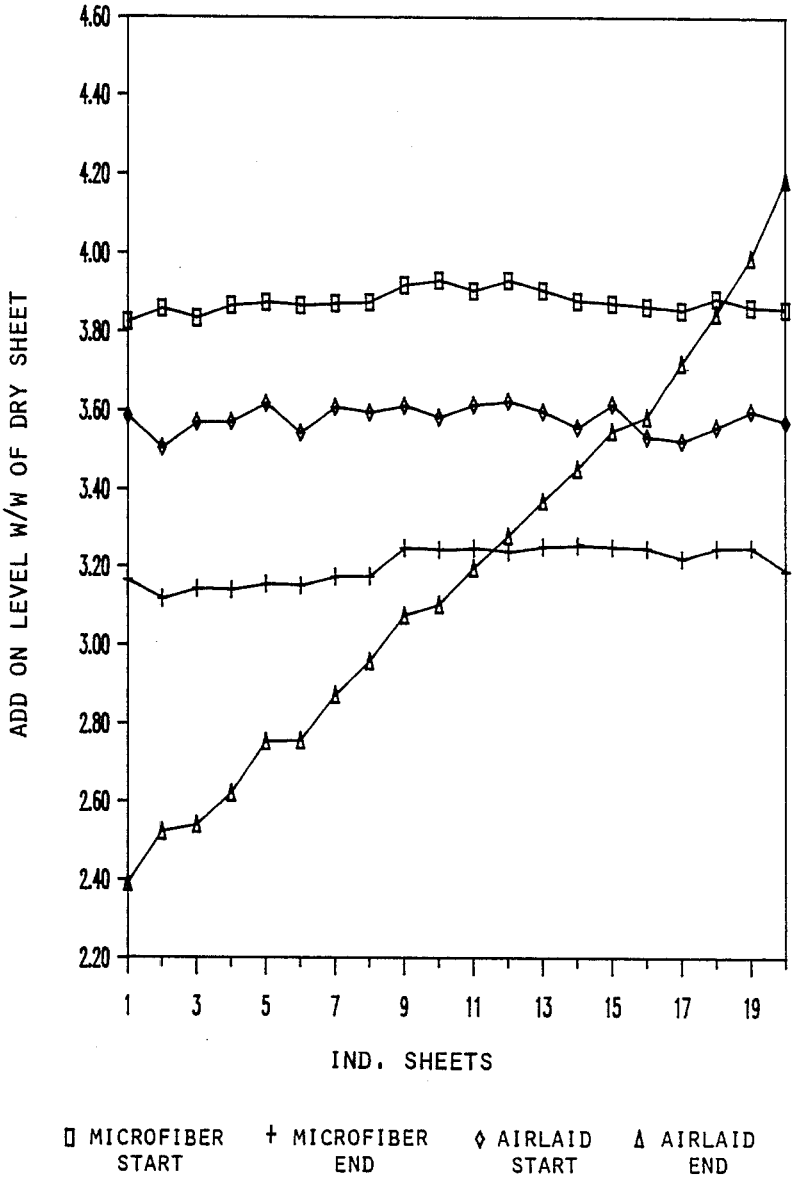

Figure 2F Liquid Retention
1 MONTH AT 50*C
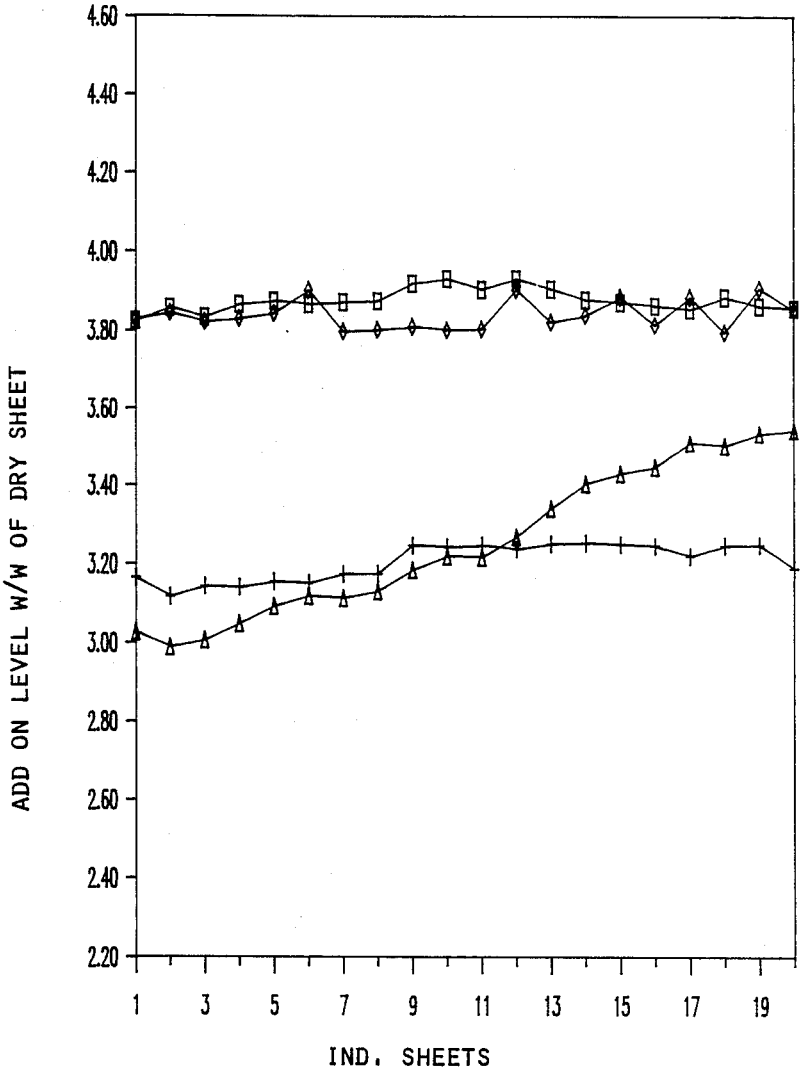
□ MICROFIBER START + MICROFIBER END ◊ MACROFIBER START Δ MACROFIBER END

UNIFORMLY MOIST ABRASIVE WIPES

BACKGROUND OF THE INVENTION

This application is a continuation-in-part of copending application Ser. No. 06/896,895 filed Aug. 15, 1986, now U.S. Pat. No. 4,775,582.

Wet wipes are well known commercial consumer products which are available in many forms. Perhaps the most common form is a stack of individual folded sheets packaged in a plastic container for use as baby wipes. The individual sheets are predominantly made from airlaid cellulosic fibers and are saturated with a suitable wiping solution. Unfortunately, the amount of solution varies from sheet to sheet, gradually increasing from the top of the stack to the bottom, particularly after the container has been opened and the upper sheets have partially dried. In addition, since the solution tends to migrate toward the bottom due to gravity, there often is a pool of liquid in the bottom of the container. This, of course, is wasted solution.

Therefore there is a need for a product that provides a stack of wipes having uniform moisture throughout the stack.

SUMMARY OF THE INVENTION

In one aspect, the invention resides in a moist abrasive wipe comprising at least one abrasive surface layer thermally bonded to a meltblown supporting web, said abrasive layer comprising meltblown fibers and shotty deposits having a diameter of at least about 40 micrometers. The abrasive layer can be on one or both sides of the supporting web.

In another aspect, the invention resides in a stack of moist abrasive wipes comprising a plurality of moist abrasive sheets, said sheets containing from about 100 to about 700 dry weight percent liquid and comprising an abrasive surface layer thermally bonded to a meltblown supporting web, said abrasive surface layer comprising meltblown fibers and shotty deposits having a diameter of at least about 40 micrometers, wherein each of the sheets within the stack of wipes contains substantially the same concentration of liquid.

It has been discovered that wettable polyolefin meltblown webs surprisingly possess the ability to absorb and hold an amount of fluid sufficient for purposes of a moist wipe. When a stack of such wipes is allowed to stand for long periods of time, within a container, the concentration of liquid within each sheet remains substantially equal. If the upper sheets of the stack experience evaporation losses, the lower sheets give up some liquid to equilibrate the liquid concentration throughout the stack. This unique property is very desirable from the user's point of view because the top sheet is never dried out. This property also avoids wasting solution pooled in the bottom of the container. Providing such meltblown webs with a unique meltblown abrasive surface layer creates a very useful abrasive wet wipe product, particularly useful for cleaning bathroom fixtures. The presence of the abrasive meltblown layer does not prevent the solution from equilibrating within the stack.

For purposes herein, the term "stack" is used broadly to include any collection of sheets or webs wherein there is a plurality of surface-to-surface interfaces. This not only includes a vertically stacked collection of individual sheets, but also includes a horizontally stacked collection of sheets and a rolled collection of sheets. In the case of a horizontal stack in accordance with this invention, where the individual sheets are standing on edge, the liquid concentration will be maintained substantially equal from the top to the bottom of each individual sheet, as well as from sheet to sheet. Similarly, with a rolled product form wherein a continuous web of meltblown material is perforated to separate individual sheets and wound into a roll, the concentration of liquid within the roll will equilibrate to substantially equal concentrations, regardless of the orientation of the roll within a dispenser.

Meltblown webs or sheets suitable as supporting webs for the abrasive wipes of this invention are well known in the nonwovens industry. Typically such materials are made of polypropylene, although other thermoplastic polyolefins, such as polyethylene, etc. can also be used. Basis weights can be from about 15 to about 200 grams per square meter (gsm), preferably from about 25 to about 100 gsm, with a basis weight of about 40 gsm being most preferred. While not wishing to be bound to any theory of operation, it is believed that meltblown polyolefin webs are unique materials which, on the one hand, tightly hold the liquid and, on the other hand, readily transfer the liquid to adjacent contacting meltblown webs through capillary action. At the same time the web will readily express the liquid during use. The method for making meltblown webs is adequately described in U.S. Pat. No. 3,978,185 to Bunting et al. dated Aug. 31, 1976. On a commercial basis, suitable meltblown webs are available from Kimberly-Clark Corporation, Roswell, Ga.

Manufacture of the abrasive meltblown materials useful for purposes of this invention is described in U.S. Pat. No. 4,659,609 entitled "Abrasive Web and Method of Making Same," issued Apr. 21, 1987, which is herein incorporated by reference. The method for making an abrasive web in accordance with this invention comprises meltblowing a polymer melt onto the meltblown supporting web such that the meltblown fibers and shotty deposits are at a temperature at or above the polymer softening point and remain sufficiently semimolten (hot and fusible) to thermally bond to the supporting web. By making a composite web in this manner, the resulting top layer of meltblown fibers and shotty deposits, which fibers are thicker than conventional meltblown fibers, intimately bond to the supporting meltblown web and harden into an abrasive surface. The resulting layered web thus exhibits the strength and absorbent characteristics of the supporting web and the abrasiveness of the meltblown layer.

As described in the above-mentioned U.S. Pat. No. 4,659,609, a number of variables can be manipulated to achieve the desired abrasive layer characteristics. These variables include the characteristics of the polymer, the temperature of the melt, the design of the meltblowing die tip, the denier of the extruded melt and resulting fibers, the melt flow rate, the meltblowing air temperature and flow rate, the distance between the die tip and the supporting web, the basis weight of the meltblown layer, and the nature of the supporting web. However, those skilled in the art of manufacturing nonwoven webs will readily be able to manipulate these variables as necessary to achieve semimolten meltblown fibers and shotty deposits capable of bonding to the supporting web to form the abrasive surface.

The meltblown abrasive layer intimately thermally bonded to the meltblown supporting layer can have a basis weight of from about 1 to about 25 gsm, preferably from about 3 to about 10 gsm. It comprises large diameter fibers and fiber bundles having a diameter of at least about 40 micrometers, preferably from about 40 to about 200 micrometers. Although a wide range of fiber diameters may be present, it is believed that those in the abovesaid size range or larger are responsible for the abrasive properties of the abrasive layer. Preferably, the abrasive layer also contains shotty deposits which can be of much larger size (diameter) than that of the fibers. Shotty deposits typically range in size from about 40 to about 2000 micrometers or larger. It will be appreciated that the term "diameter" is used loosely to describe the general size of the fiber diameter and the shotty deposit size as if they were perfectly round. Clearly, however, both forms are very irregular as shown in the photographs of FIGS. 3–5. It is preferred that the abrasive layer consist essentially of such fibers and/or shotty deposits in order to maximize the abrasive effect. The relative proportion of shotty deposits and large diameter fibers is a function of the processing conditions. Both provide abrasive characteristics. Such a web provides an abrasive wipe at very low materials costs because the meltblown abrasive layer is very thin, having a basis weight substantially lower than typical meltblown webs. A preferred basis weight is about 5 or 6 gsm.

Suitable polymer materials useful for producing the meltblown abrasive layer of the layered web of this invention must be capable of being thermally bonded to the supporting web so that as the abrasive layer is deposited onto the supporting web, some melting of the fibers of the supporting web takes place to form a thermal bond between the abrasive layer and the supporting web. With this understanding in mind, suitable polymer materials include, without limitation, polypropylene, polyethylene, nylon, polyethers, ethylene vinyl acetate, polyvinyl chloride, polyesters, and copolymers thereof. However, polypropylene having a weight average molecular weight greater than about 200,000 is preferred because of its availability, ease of spinning, and mild abrasive properties. It will be understood that the term "abrasive," as used herein, represents a surface texture which enables the wipe to scour the surface being wiped and to remove dirt. The abrasiveness can vary depending on the polymer of the abrasive layer and the degree of texture. The preferred abrasive wipe of this invention is sufficiently mildly abrasive such that it will not scratch plastic bathroom tub enclosures any more than do paper towels. Hence the abrasive qualities are very mild, yet texture is relatively high. Suitable commercially available materials include Exxon 3214, Exxon 3045, Himont PF015, and Hercules PRO-FAX polypropylene pellets.

The liquid contained within the wipes of this invention can be any aqueous cleaning solution or germicidal solution which can be absorbed into the wipe. Based on the dry weight of the supporting web, the amount of the liquid within the wipe on a weight percent basis can be from 100 to about 700 percent, suitably from about 150 to about 500 percent, advantageously from about 200 to about 450 percent, preferably from about 350 to about 400 percent, and most preferably about 380 percent. If the amount of liquid is less than the abovesaid range, the wipe will be too dry and will not adequately perform. If the amount of liquid is greater than the abovesaid range, the wipe will be too soggy and the liquid will begin to pool in the container. In all of the product forms of this invention, it can be advantageous to impregnate the product with various additives, such as detergents, surfactants, cleaners, bleaches, perfumes, disinfectants, germicides, virucides, etc.

BRIEF DESCRIPTION OF THE DRAWING

FIG. 2A is a plot of the liquid concentration of individual sheets within a vertical stack of 20 sheets which has been standing at room temperature for one month, comparing the liquid retention of the microfiber meltblown sheets used as a supporting web for the abrasive wipe of this invention with that of the prior art airlaid cellulosic web at the start and the end of the test period.

FIG. 2B is a plot similar to FIG. 2A, comparing the liquid retention of a stack of polypropylene microfiber meltblown sheets and a stack of polypropylene macrofiber meltblown sheets.

FIG. 2C is a plot similar to FIG. 2A, wherein the stacks of microfiber meltblown and airlaid sheets have been standing for one month at 40° C., illustrating the lack of effect of temperature on the ability of the microfiber meltblown sheets to equilibrate.

FIG. 2D is a plot similar to FIG. 2B, wherein the microfiber meltblown stack and the macrofiber meltblown stack have been standing for one month at 40° C.

FIG. 2E is a plot similar to FIGS. 2A and 2C, wherein the stacks of microfiber meltblown and airlaid sheets have been standing for one month at 50° C.

FIG. 2F is a plot similar to FIGS. 2B and 2D, wherein the stacks of microfiber meltblown and macrofiber meltblown sheets have been standing for one month at 50° C.

DETAILED DESCRIPTION OF THE DRAWINGS

Figure 1:
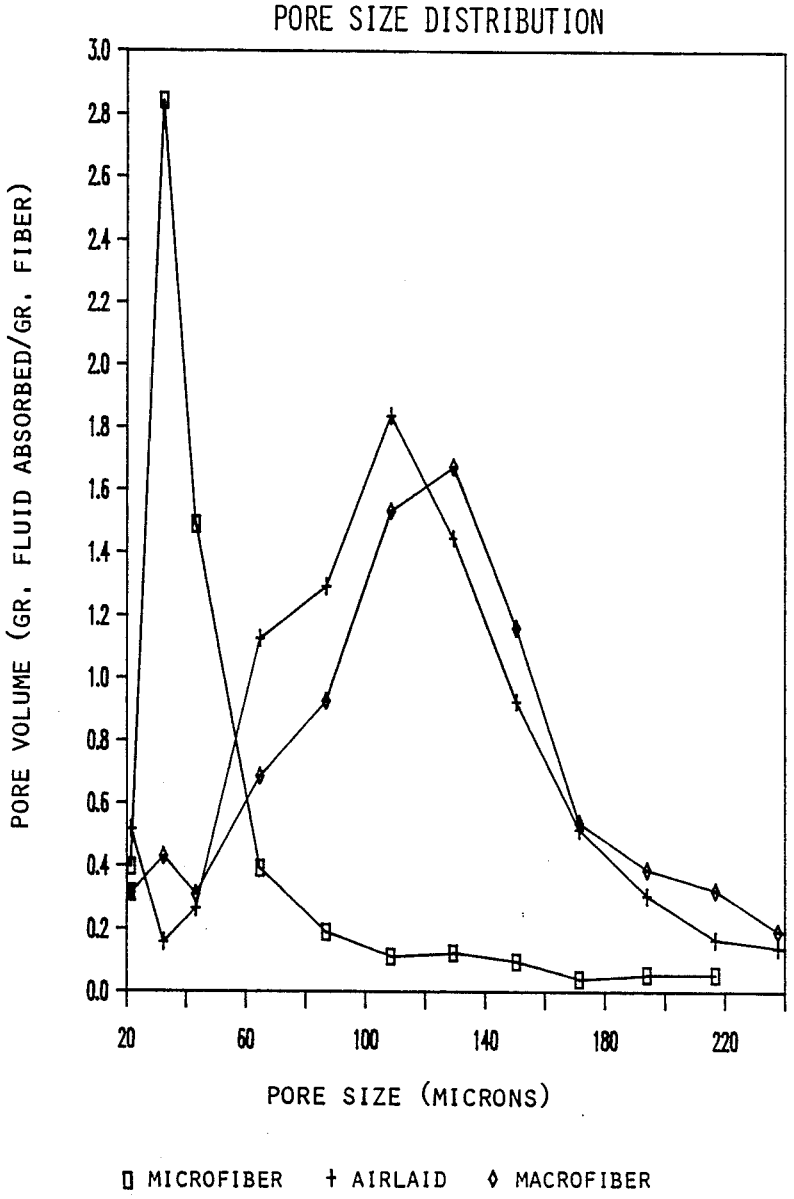
FIG. 1 is a plot of the fluid absorption per gram of fiber vs. the pore size for a polypropylene microfiber (hereinafter defined) meltblown web, an airlaid web used for prior art wipes, and a polypropylene macrofiber meltblown web formed from fibers having a larger diameter than those used to form the microfiber web, illustrating the pore size distribution of each web. The terms "microfiber" and "macrofiber" are only used herein to distinguish between webs having different pore size distributions.

FIG. 1 illustrates the pore size distribution of the microfiber and macrofiber meltblown webs used as supporting webs for the abrasive wipes of this invention compared to the pore size distribution of an airlaid web currently used for commercially available wet wipes. It is believed that the pore size distribution may be a significant factor in the performance of the wipes of this invention. As shown by the plot, the majority of the absorbence of the microfiber meltblown, which is preferred, is due to pores having a size of from about 20 to about 60 microns. (Pore size distribution is determined by the capillary suction method described in copending application Ser. No. 853,494 filed Apr. 18, 1986 in the names of D. D. Endres et al., which is herein incorporated by reference.) For the sample microfiber meltblown sheet represented in FIG. 1, the pore volume which is due to pores having a size of from about 20 to about 60 microns is 77%, as calculated by the area under the curve. For purposes herein, "microfiber" meltblown refers to meltblown webs in which at least 65% of the pore volume is attributed to pores having a size of from about 20 to about 60 microns. "Macrofiber" meltblown refers to webs having less than 65% of the pore volume attributable to pores having a size of from about 20 to about 60 microns.

FIGS. 2A, 2C, and 2E illustrate the ability of the microfiber meltblown web to maintain a constant and equal fluid concentration throughout a stack of sheets, in contrast to the liquid pooling tendencies of the airlaid sheets of the prior art. FIGS. 2B, 2D, and 2F compare the properties of microfiber meltblown webs and macrofiber meltblown webs. In generating the data for all of the FIG. 2 plots, 20 wipes were saturated with a cleaning solution at an add-on level of about 380 weight percent liquid based on the dry weight of the sheet. The cleaning solution contained the following ingredients on a weight percent basis: 0.12% Bardac 205M (50% active); 0.005 sodium metasilicate pentahydrate (100% active); 0.03 tetrasodium EDTA (100% active); 0.115 Tergitol 15-S-12 (100% active); 0.18 Fragrance; 99.55 Deionized water. The individual sheet size was 10 inches×13 inches. The individual sheets were quarter-folded and stacked to form a clip of 20 quarter-folded sheets. The clips were double-bagged in sealed plastic bags and allowed to stand for a set period of time at a set temperature. Three clips were tested at each set of conditions. The liquid content of each individual sheet within the clip was measured at the beginning and end of the test. The plots compare the results of this test for the meltblown web of this invention and the airlaid cellulosic web used for current commercially available wet wipes.

In all cases, the microfiber meltblown sheets maintained a substantially constant liquid content from the top sheet of the stack (sheet No. 1) to the bottom of the stack (sheet No. 20) as illustrated by the horizontal plot. On the other hand, the airlaid sheet exhibited an increasing liquid content from the top sheet to the bottom sheet, as illustrated by the positive slope of the airlaid plot.

It is also worthwhile to note that as the temperature of the test increased, the amount of liquid lost to evaporation also increased, as indicated by the vertical distance between the starting concentration plot and the finish concentration plot. Nevertheless, in spite of this liquid loss, all sheets within the microfiber meltblown stack equilibrated to maintain a substantially equal liquid concentration. The macrofiber meltblown stack appeared to show some temperature effect as shown in FIG. 2F, but nevertheless is greatly improved relative to the airlaid sheets at the same conditions. Hence all of the meltblown sheets provide a supporting web for the abrasive layer which provides for equilibration of the liquid concentration within the stack.

Figure 3:
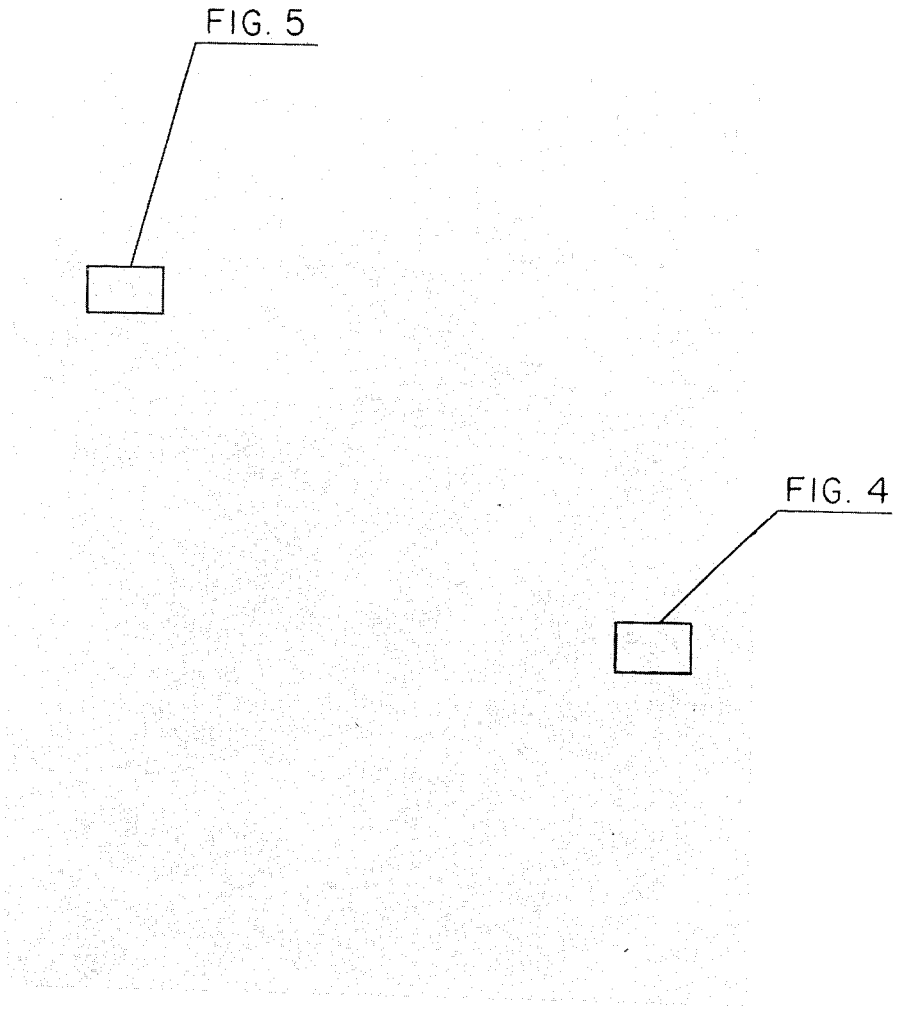
FIG. 3 is an actual size photograph of the surface of a product in accordance with this invention, illustrating the nature of the abrasive meltblown surface layer.

FIG. 3 is an actual size photograph of the surface of an abrasive wipe in accordance with this invention. The photograph illustrates the nature of a 6 gsm meltblown abrasive layer, which has been dyed aqua. The substrate, which is a microfiber meltblown sheet, is white. As is apparent from the photograph, the meltblown abrasive layer is generally evenly distributed over the supporting web, although local irregularities are common because of the practical difficulty of evenly forming such a light basis weight web. The abrasive layer consists of a mix of shotty deposits (irregular-shaped polymeric globules), large fibers, and hybrid combinations of both forms. Some smaller diameter fibers are also present, but they are not known to contribute to the textured properties of the abrasive layer.

Figure 4:
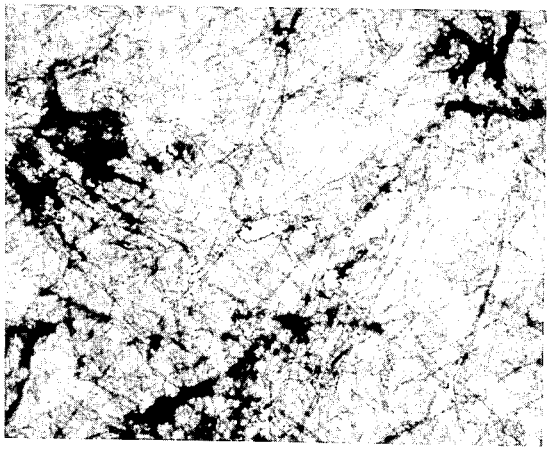
FIG. 4 is a magnified (10×) photograph of a portion of the product of FIG. 3.

FIG. 4 is a magnified (10×) photograph of a portion of the product of FIG. 3, further illustrating the nature of the abrasive layer. As shown by the photograph, the abrasive meltblown layer essentially consists of thick fibers and shotty deposits having a diameter greater than about 40 microns.

Figure 5:
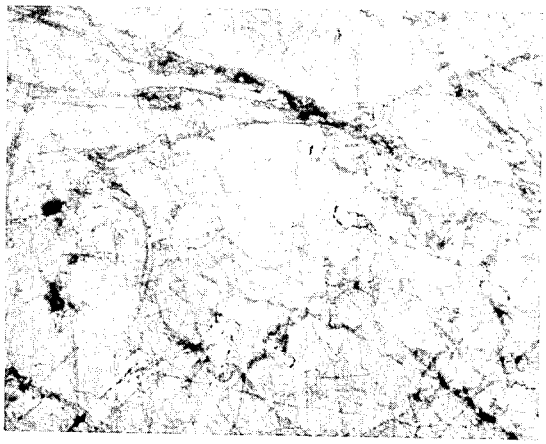
FIG. 5 is another magnified (10×) photograph of a different portion of the product of FIG. 3.

FIG. 5 is another magnified (10×) photograph of a different portion of the product of FIG. 3, further illustrating the diverse nature of the abrasive meltblown layer.

It will be appreciated that the foregoing examples, shown for purposes of illustration, are not to be construed as limiting the scope of the invention, which is defined by the following claims.

We claim:

1. A stack of moist abrasive wipes within a container, said stack comprising a plurality of moist abrasive sheets, said sheets comprising an abrasive surface layer thermally bonded to a meltblown supporting web and containing from about 100 to about 700 dry weight percent liquid based on the dry weight of the supporting web, said abrasive surface layer comprising meltblown fibers and irregular-shaped polymeric globules having a diameter of at least about 40 micrometers, wherein each of the sheets within the stack of wipes contains substantially the same concentration of liquid and can maintain an equal concentration of liquid for at least 30 days.

2. The stack of moist abrasive wipes of claim 1 wherein the sheets have an abrasive surface layer on both sides of the supporting web.

3. The stack of moist abrasive wipes of claim 1 wherein the sheets have an abrasive surface layer only on one side of the supporting web.

4. The stack of moist wipes of claim 1 wherein said sheets contain from about 150 to about 500 weight percent liquid based on the dry weight percent of the supporting web.

5. The stack of moist wipes of claim 4 wherein said sheets contain from about 350 to about 400 dry weight percent liquid.

6. The stack of moist wipes of claim 1 wherein the abrasive surface layer has a basis weight of from about 1 to about 25 grams per square meter.

7. The stack of moist wipes of claim 6 wherein the abrasive surface layer has a basis weight of from about 3 to about 10 grams per square meter.

8. The stack of moist wipes of claim 1 wherein the supporting web is a microfiber meltblown web.

9. The stack of moist wipes of claim 8 wherein the meltblown abrasive layer and the microfiber meltblown supporting layer are polypropylene.

* * * * *